US006092562A

United States Patent [19]

Debaes

[11] Patent Number: 6,092,562

[45] Date of Patent: Jul. 25, 2000

[54] METHOD FOR MANUFACTURING A PILE FABRIC WITH COARSE PILE WARP THREADS

[75] Inventor: Johnny Debaes, Moorslede, Belgium

[73] Assignee: N.V. Michel Van de Wiele, Kortrijk/Marke, Belgium

[21] Appl. No.: 09/201,817

[22] Filed: Dec. 1, 1998

[30] Foreign Application Priority Data

Dec. 1, 1997 [BE] Belgium ..... 09700970

[51] Int. Cl.[7] ..... D03D 27/06

[52] U.S. Cl. ..... 139/398; 139/21

[58] Field of Search ..... 139/11, 20, 21, 139/27, 37, 43, 116.5, 291 C, 391, 392, 394, 397, 398, 404, 405, 407, 408, 440, 411, 412; D03D 27/06

[56] References Cited

U.S. PATENT DOCUMENTS

| | | | |
|---|---|---|---|
| 2,247,308 | 6/1941 | Redman | 28/1 |
| 3,013,325 | 12/1961 | McNally et al. | 28/72 |
| 3,327,738 | 6/1967 | Sabbe | 139/398 |
| 3,394,739 | 7/1968 | Crenshaw et al. | 139/21 |
| 4,456,035 | 6/1984 | Bruggemann et al. | 139/398 |
| 5,398,730 | 3/1995 | Derudder et al. | 139/21 |
| 5,400,831 | 3/1995 | Gheysen | 139/21 |
| 5,522,435 | 6/1996 | DeRudder | 139/65 |
| 5,655,573 | 8/1997 | Gheysen et al. | 139/21 |

FOREIGN PATENT DOCUMENTS

| | | |
|---|---|---|
| 0 628 649 | 12/1994 | European Pat. Off. . |
| 0 805 226 | 11/1997 | European Pat. Off. . |
| 2 253 262 | 11/1973 | Germany . |
| 1 400 297 | 7/1975 | United Kingdom . |

*Primary Examiner*—John J. Calvert
*Assistant Examiner*—Robert H. Muromoto, Jr.
*Attorney, Agent, or Firm*—James Creighton Wray; Meera P. Narasimhan

[57] ABSTRACT

Method for manufacturing a pile fabric with pile loops formed by coarse pile threads (10–15), such as an Axminster carpet, on a face-to-face weaving machine with which weft threads (1), (2), (3) can be inserted on three insertion levels, whereby in successive insertion cycles (a), (b) in each case two weft threads (2), (3); (1), (2) are inserted, so that in a first (a) and a second insertion cycle (b) respectively on the top and on the bottom insertion level no weft thread is inserted, and whereby pile-forming pile warp threads (13), (14), (15) are provided during every first insertion cycle (a) above the top insertion level and during every second (b) insertion cycle under the bottom insertion level.

10 Claims, 1 Drawing Sheet

METHOD FOR MANUFACTURING A PILE FABRIC WITH COARSE PILE WARP THREADS

BACKGROUND OF THE INVENTION

This invention generally relates to a method for manufacturing a pile fabric with pile loops formed by coarse pile threads. In particular this invention relates to a new method for manufacturing carpets, whereby coarse pile warp threads are used, such as for example the type of carpets with a low pile row density that up until now are manufactured by means of an Axminster weaving machine. In that which follows, these carpets are referred to as Axminster carpets.

The known Axminster gripper weaving machines are provided with a weft insertion mechanism for inserting weft threads between warp threads so that a backing fabric is formed, with a pile gripper mechanism with several up and down rotatable pile grippers, and with pile loaders in which a number of pile warp threads are provided one above the other and can be fed to the pile grippers. Prior to each weft insertion the pile warp threads with the desired color (corresponding to the pattern to be woven) can be brought to the respective pile grippers by means of a jacquard mechanism, if these pile grippers are rotated to their top position. During the downward rotation of the pile grippers the pile warp threads are pulled over a specific length out of the loader. The pulled-out part of the respective pile warp threads is cut off, is brought to the fabric edge by the further downward movement of the pile grippers, and is there held in an inweaving position in order finally after insertion of weft threads to be woven into the backing fabric as a pile loop.

The pile grippers disposed one next to the other must have a minimum thickness in order to have sufficient stability. This results in the reed density having to be maintained rather low with Axminster weaving machines. Generally this reed density is limited to at most 7 per inch (276/meter). Exceptionally reed densities from 8 to 10 per inch are also utilized, but even in those cases pile fabrics with a rather low pile row density are obtained.

In order nevertheless to obtain a certain volume of pile yarn with the pile fabrics which are woven with these Axminster weaving machines, rather thick pile yarns are usually used. Preferably pile yarns of the carded type are used in a yarn number range from Nm 3.2/2 to Nm 3.6/2.

A disadvantage of the known methods for manufacturing pile fabrics with pile loops formed by coarse pile threads lies in the fact that the Axminster weaving machines used for that purpose run rather slowly because of their mechanical complexity. The productivity of the known methods is consequently rather low.

It has been attempted to remedy the above mentioned disadvantage by using face-to-face weaving machines. The operating speed of these weaving machines (e.g. 120 revolutions per minute) indeed lies much higher than the Axminster weaving machines (e.g. 65 revolutions per minute). Furthermore the weft insertion mechanism of these weaving machines is provided for simultaneously inserting two weft threads in each case in successive insertion cycles.

When manufacturing a pile fabric on a face-to-face weaving machines a top and a bottom backing fabric are woven by inserting weft threads in sheds formed between warp threads, while pile-forming pile warp threads are so positioned in relation to the weft insertion levels that these are alternately passed round one or several weft threads in the top and in the bottom backing fabric. The pile-forming pile warp threads are afterwards cut through between the two backing fabrics so that two pile fabrics are obtained.

Manufacturing a pile fabric with pile loops formed by coarse pile threads on a face-to-face weaving machines, such as for example an Axminster carpet, appeared however until now to be impossible. The coarse pile warp threads indeed appeared not be weavable on face-to-face weaving machines because with the shed formation they entangle with each other too easily. This results in a shed which is not perfectly formed. Because of this pile warp threads are damaged or torn off by a weft insertion means moving in the shed, and inwoven non-pile-forming pile warp threads are upset so that they form unwanted pile loops both along the back and along the pile side of the fabric. Because of this it was until now considered impossible to weave pile fabrics with coarse pile warp threads, such as for example Axminster carpets, on face-to-face weaving machines in order to increase the productivity.

SUMMARY OF THE INVENTION

A purpose of this invention is to provide a new method according to which pile fabrics with pile loops formed by coarse pile threads can be manufactured with a higher productivity than with the known methods.

An additional purpose is that the method provided according to this invention makes it possible to manufacture pile fabrics which look almost the same and feel almost the same as the know pile fabrics which are manufactured by means of an Axminster weaving machine.

The above mentioned aims are achieved by providing a method whereby on a face-to-face weaving machines which is provided for inserting weft threads between warp threads on three insertion levels, a top and a bottom backing fabric are formed, whereby in successive insertion cycles in each case two weft threads are inserted, so that in a first and a second insertion cycle respectively on the top and on the bottom insertion level no weft thread is inserted, whereas pile-forming coarse pile warp threads are provided during every first insertion cycle above the top insertion level and during every second insertion cycle under the bottom insertion level, and whereas these pile warp threads are subsequently out through between the two backing fabrics in order to obtain two pile fabrics.

Through this new method it is now nevertheless possible to weave coarse pile warp threads on a face-to-face weaving machine, and therefore to come to a considerably higher productivity. It has been recognized that the entanglements between pile warp threads mostly take place where pile warp threads cross one another, and that most problems occur through entanglement of non-pile-forming and pile-forming pile warp threads.

According to the new method according to this invention pile-forming pile warp threads are either brought above that top insertion level if not weft thread is inserted on the top insertion level, or brought under the bottom insertion level is no weft thread is inserted on that bottom insertion level. The shed of which the pile-forming pile warp threads are part is therefore in each case formed on an insertion level on which no weft thread is inserted. In this shed no weft threads are therefore inserted. Therefore, every problematic weft insertion in a shed which can be imperfect as a result of an entanglement of pile warp threads, is prevented. In particular any damage of breakage of pile warp threads resulting from the movement of a weft insertion means in this shed can be prevented since the weft insertion means in question can be eliminated.

Furthermore the pile-forming pile warp threads and the non-pile-forming pile warp threads can in that manner be well separated from one another, in order to reduce the risk of entanglement of these pile warp threads.

With the method according to this invention preferably a first and a second insertion cycle is alternately performed. In that manner a pile fabric with a ½ V-weave is obtained for the pile warp threads, in which the pile warp threads are not woven through.

It is furthermore also preferable to weave in the non-pile-forming (parts of) pile warp threads into the backing fabric, and thereby divide them over the top and the bottom backing fabric. In that manner according to the method according to this invention two almost identical pile fabrics are obtained.

According to a very preferred method according to this invention a (part of a) pile warp thread to be woven into the top backing fabric is provided during every first insertion cycle above the top insertion level, and provided during every second insertion cycle between the two insertion levels on which a weft thread is inserted; and a (part of a) pile warp thread to be woven into the bottom backing fabric is provided during every first insertion cycle between the two insertion levels on which a weft thread is inserted, and provided during every second insertion cycle under the bottom insertion level.

In a first insertion cycle a weft thread is only inserted on the middle and on the bottom insertion level, whereas the pile-forming pile warp threads and the non-pile-forming (dead) pile warp threads which have to be woven into the top backing fabric are above the top insertion level, and whereas the dead pile warp threads which have to be woven into the bottom backing fabric are between the middle and the bottom insertion level.

The pile-forming pile warp threads, and the dead pile warp threads to be woven into the top fabric, and brought to one and the same height and do not therefore have to cross each other with the shed formation. Consequently no entanglement occurs between these warp threads. Furthermore in the shed which these warp threads form no weft thread is even inserted.

The dead pile warp threads to be woven into the bottom fabric and between the middle and the bottom insertion level, and do not therefore have to cross each other either. Furthermore they are also well separated from the pile-forming pile warp threads so that no entanglement is possible with those pile warp threads either.

In a second insertion cycle a weft thread is only inserted on the middle and on the top insertion level, whereas the pile-forming pile warp threads and the dead pile warp threads which have to be woven into to the bottom backing fabric are below the bottom insertion level, and whereas the dead pile warp threads which have to be woven into the top backing fabric are between the middle and the top insertion level.

In the same manner as during the first insertion cycle during a second insertion cycle the crossing of dead and pile-forming pile warp threads or of dead pile warp threads together is also prevented, and the dead warp threads to be woven into the top fabric and the pile-forming pile warp threads are well separated from each other. During this second insertion cycle the entanglement of coarse pile warp threads is therefore also precluded.

This method is therefore preferably implemented with a face-to-face weaving machine which comprises three weft insertion means, which are provided in order to move in successive insertion cycles in a shed formed between warp threads in order to insert a weft thread on a respective insertion level, whereas the weft insertion means is disengaged with the top insertion level in every first insertion cycle, and the weft insertion means is disengaged with the bottom insertion level in every second insertion cycle.

The pile warp threads can best be positioned by means of a four-position jacquard machine. The coarse pile warp threads are preferably of the carded type, and/or have a yarn number of at least Nm 3.2/2.

The face-to-face weaving machine has a reed density of maximum 10 per inch. A reed density of 7 per inch is preferable.

According to the method according to this invention a carpet can be woven that looks like an Axminster carpet, and that also feels like an Axminster carpet, with a considerably higher productivity that in the known manner with an Axminster weaving machine.

This invention is further explained in the following specification of a preferred method for weaving an Axminster carpet on a face-to-face weaving machine according to this invention. In this specification reference is made to the drawings attached hereto, of which

DETAILED DESCRIPTION OF THE PREFERRED EMBODIMENTS

Figure 1:
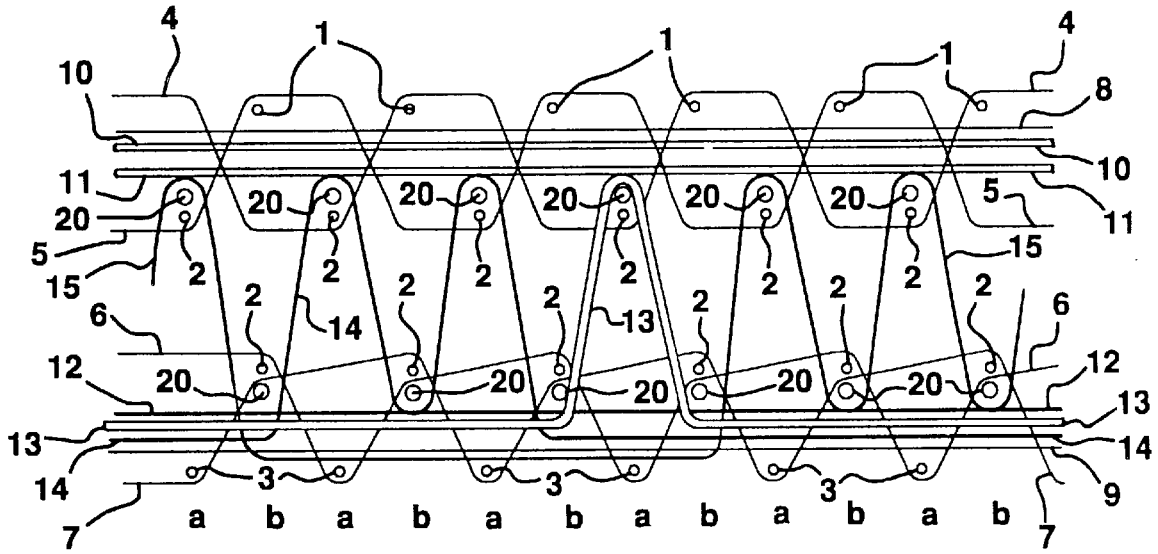
FIG. 1 is a schematic cross-section in warp direction of a part of an Axminster carpet manufactured according to this preferred method, on which the insertion locations of the disengaged weft insertion means are indicated by small non-filled circles in order to clarify the method.
Figure 2:
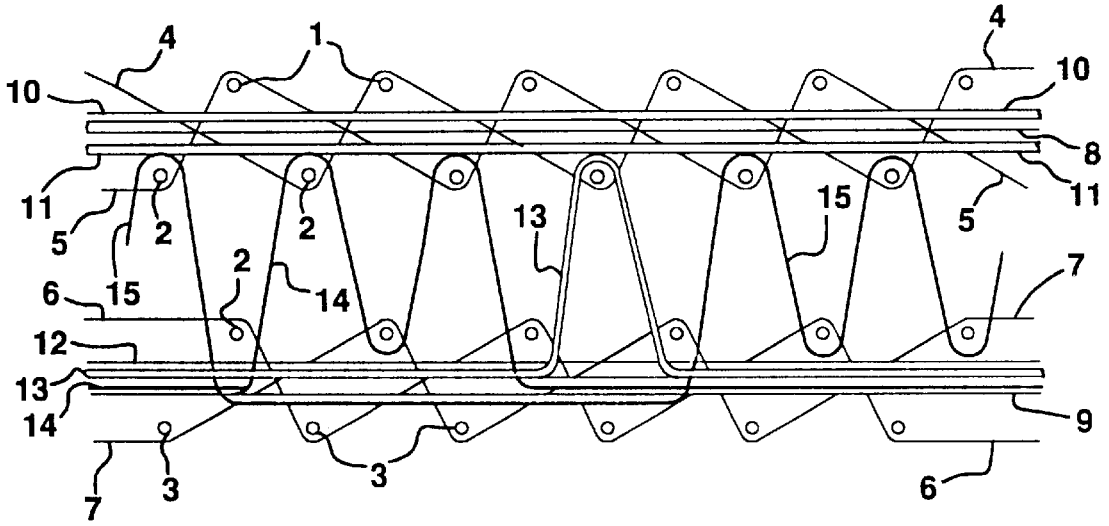
FIG. 2 is the schematic cross-section from FIG. 1 without indication of the above mentioned insertion locations.

With a most preferred method according to this invention use is made of a face-to-face weaving machine, with a weft insertion mechanism that is provided in order during successive insertion cycles (a), (b) in each case on three different insertion levels to insert weft threads (1), (2), (3) in sheds formed between warp threads. This mechanism comprises for that purpose three gripper systems with grippers which can move between the warp threads (4–15) according to movement paths respectively located one above the other.

The top and the bottom gripper systems are alternately disengaged during the successive insertion cycles (a), (b).

On this weaving machine binding warp threads (4), (5), (6), (7), tension warp threads (8), (9) and coarse pile warp threads (10), (11), (12), (13), (14), (15) are provided. Prior to every weft insertion cycle (a), (b) the warp threads (4–15) are positioned with known means in relation to the three insertion levels. For the pile warp threads (10–15) this occurs by means of a known four-position jacquard machine.

The face-to-face weaving machine, and in particular the weft insertion mechanism and the means for positioning the warp threads (4–15), is so operated according to this method that the binding warp threads (4), (5), (6), (7), tension warp threads (8), (9) and the weft threads (1), (2), (3) form two backing fabrics one above the other, that coarse pile warp threads (13), (14), (15) are in the top and the bottom backing fabric alternately passed round a weft thread (2) which is not along the back of the fabric, so that these pile warp threads are not woven through and form pile according to a ½ V-weave, and that the non-pile-forming (parts of) pile warp threads (10–15) divided over the top and the bottom backing fabric are woven into these backing fabrics.

The positions of the warp threads (4–15) in relation to the three insertion levels are best to be seen in FIG. 1. In that figure the insertion locations (20) have indeed been indicated of the disengaged gripper systems (in other words the locations (20) where a weft thread would have been inserted in the fabric, if the gripper system in question would have operated). In the figures the weft threads which have been inserted by the top, the middle and the bottom gripper system are respectively indicated by reference numbers 1, 2, and 3.

In the successive insertion cycles (a), (b) the top and the bottom gripper system are alternately disengaged. A first insertion cycle (a) and a second insertion cycle (b) are therefore performed alternately.

With every first insertion cycle (a) the top gripper system is disengaged, while the middle and the bottom gripper system insert a respective weft thread (2), (3). During every first insertion cycle (a) the pile warp threads (13), (14), (15), which have to form pile are brought above the movement path of the top (disengaged) gripper system. The pile warp threads (10), (11) which do not have to form pile but have to be woven into the top backing fabric are also brought above the movement path of the top gripper system. The pile-forming pile warp threads (13), (14), (15) and the dead pile warp threads (10), (11) do not therefore have to cross each other, so that an entanglement between these coarse pile warp threads is prevented. In this shed, which is formed by the top pile warp threads, no weft thread is even inserted at all, since the gripper system in question is disengaged. The grippers will therefore not be able to damage or tear any pile warp threads (10), (11), (13–15) either.

All non-pile-forming pile warp threads (12), (13), (14), (15), which have to be woven into the bottom backing fabric, are during this first insertion cycle (a) brought between the movement paths of the operating gripper systems (i.e. the middle and the bottom gripper system). There are therefore no crossing pile warp threads there either, and entanglement is therefore prevented.

During every second insertion cycle (b) the bottom gripper system is disengaged, while a respective weft thread (1), (2) is inserted by the top and the middle gripper system. The pile-forming pile warp threads (13), (14), (15) and also the non-pile-forming pile warp threads (12–15) which have to be woven into the bottom backing fabric, are brought under the movement path of the bottom (disengaged) gripper system, while the non-pile-forming pile warp threads (10), (11) which have to be woven into the top backing fabric are between the movement paths of the operating gripper systems (i.e. the middle and the top gripper system). Here the crossing of the pile warp threads is also prevented, so that no entanglement occurs and a perfect shed can be formed.

The pile-forming (parts of) pile warp threads (13–15) and the non-pile-forming (parts of) pile warp threads (10–15) are according to this method furthermore also well separated from each other with every weft insertion. The risk of entanglement of these pile warp threads is even less because of this.

Due to this method coarse pile warp threads are weavable on face-to-face weaving machines, and it is therefore also possible to weave Axminster pile fabrics on face-to-face weaving machines, and in so doing to obtain a higher productivity.

The carpets manufactured according to this method look almost the same and feel almost the same as Axminster carpets which are woven on an Axminster weaving machine.

What is claimed is:

1. A method for manufacturing a pile fabric with pile loops of coarse pile threads on a face-to-face waving machine comprising forming a cop and a bottom backing fabric by inserting plural weft threads between plural warp threads on three insertion levels in plural insertion cycles, inserting two weft threads in each successive insertion cycle wherein no weft thread is inserted in a first and a second insertion cycle respectively on a top and on a bottom insertion level, inserting pile-forming coarse pile warp threads during every first insertion cycle above the top insertion level and during every second insertion cycle under the bottom insertion level, and cutting the pile warp threads between the two backing fabrics and forming two pile fabrics.

2. The method of claim 1, wherein the inserting in the first and the second insertion cycles is performed alternately.

3. The method of claim 1, further comprising weaving non-pile-forming parts of the pile warp threads into the backing fabric, and dividing the pile warp threads over the top and the bottom backing fabrics.

4. The method of claim 3, wherein the weaving further comprises weaving a part of the pile warp thread into the top backing fabric during every first insertion cycle above the top insertion level and during every second insertion cycle between the two insertion levels during insertion of the weft thread, and weaving another part of the pile warp thread into the bottom backing fabric during every first insertion cycle between the two insertion levels during insertion of the weft thread and during every second insertion cycle under the bottom insertion level.

5. The method of claim 1, further comprising providing three weft insertion means for moving in successive insertion cycles in a shed formed between the warp threads and inserting the weft thread on a respective insertion level, disengaging the weft insertion means with the top insertion level in every first insertion cycle and disengaging the weft insertion means with the bottom insertion level in every second insertion cycle.

6. The method of claim 1, further comprising positioning the pile warp threads by means of a four-position jacquard machine.

7. The method of claim 2, wherein the inserting coarse pile warp threads comprises using carded-type pile warp threads.

8. The method of claim 7, wherein using the coarse pile warp threads comprises using threads having a yarn number of at least Nm 3.2/2.

9. The method of claim 1, wherein the weaving comprises weaving on the face-to-face weaving machine having a read density of not more than 10 per inch.

10. The method of claim 1, wherein the weaving the fabrics comprises weaving an Axminster-type carpet.

* * * * *